United States Patent [19]

Wilsberg

[11] Patent Number: 4,750,907

[45] Date of Patent: Jun. 14, 1988

[54] PROCESS FOR WASHING DELICATE FABRICS

[75] Inventor: Heinz M. Wilsberg, Colonge, Fed. Rep. of Germany

[73] Assignee: Henkel Kommanditgesellschaft auf Aktien, Duesseldorf, Fed. Rep. of Germany

[21] Appl. No.: 866,816

[22] Filed: May 23, 1986

[30] Foreign Application Priority Data

Jun. 10, 1985 [DE] Fed. Rep. of Germany ..... 3520710

[51] Int. Cl.[4] ..... D06M 1/00; C11D 17/00; C11D 1/12

[52] U.S. Cl. ..... 8/137; 252/174.15; 252/553; 252/551; 252/548; 252/173; 252/DIG. 14

[58] Field of Search ..... 252/549, 551, 174.15, 252/553, 548, 173, DIG. 14, 321; 8/137

[56] References Cited

U.S. PATENT DOCUMENTS

| | | | |
|---|---|---|---|
| 4,395,352 | 7/1983 | Kulkarni et al. | 252/174.15 |
| 4,507,219 | 3/1985 | Hughes | 252/551 |
| 4,620,878 | 11/1986 | Gee | 252/174.15 |
| 4,637,890 | 1/1987 | Crabtree et al. | 252/549 |

*Primary Examiner*—Josephine Barr

*Attorney, Agent, or Firm*—Ernest G. Szoke; Henry E. Millson, Jr.; Real J. Grandmaison

[57] ABSTRACT

Fabrics of wool and silk are gently washed with a liquid detergent which is free of inorganic builder salts and optical brighteners, has a pH value of from about 6 and about 8, and contains the following constituents:

(a) from about 5 to about 15% by weight of the alkylglycolether sulfate sodium salt of primary $C_{12}$–$C_{18}$ alcohols containing on average from 1 to 3 ethylene glycol ether groups;

(b) from about 15 to about 22% by weight of sodium alkylbenzene sulfonate having a linear $C_{10}$–$C_{14}$ alkyl chain;

(c) from about 0.5 to about 5% by weight of fatty acid monoethanolamide of $C_{12}$–$C_{18}$ fatty acids, of which the content of saturated $C_{12}$–$C_{14}$ faty acids amounts to at least about 50 mole percent;

(d) from about 0.05 to about 0.5% by weight of an emulsified silicone defoaming agent;

(e) from about 0 to about 5% by weight of non-surface-active detergent additives; and (f) the remainder being water; wherein the total quantity of components (a)+(b) amounts to between about 20 and about 30% by weight, and the ratio by weight of components (a)+(b) to component (c) is between about 3:1 and about 25:1.

17 Claims, No Drawings

PROCESS FOR WASHING DELICATE FABRICS

BACKGROUND OF THE INVENTION

1. Field of the Invention

The present invention relates to detergent compositions for use in washing delicate fabrics such as woolen and silk, and more particularly, to liquid detergent compositions for such use which are free of inorganic builder salts, have a mild pH value, and may be employed as handwashing or machine washing detergents.

2. Description of Related Art

Detergents which are considered to be suitable for washing extremely delicate fabrics of wool or silk are known. In general, they produce a neutral to mildly alkaline reaction and, in addition to synthetic anionic surfactants, such as alkylbenzene sulfonate, fatty alcohol sulfate or alkylglycolether sulfate, often contain nonionic or cationic compounds. The nonionic surfactants are for the purpose of increasing detergency, while the cationic compounds are present to improve the softness and feel of the washed fabrics. Unfortunately, it has been found that detergents containing only alkylbenzene sulfonate as the synthetic anionic surfactant can damage the fiber structure of delicate, washable wools, particularly merino and angora wool, in the event of repeated use, whereas fatty alcohol sulfates, for example, show inadequate detergency at the necessary low washing temperatures. In cases such as these, nonionic surfactants have proven equally unfavorable because woolen fabrics washed with them feel comparatively hard and brittle. These effects may be much more serious in the case of machine washing. The addition of softening cationic surfactants, as recommended for such purposes, does not fully compensate for the loss of feel and, where anionic surfactants are present at the same time, leads to a reduction in detergency.

The addition of builder salts, such as mildly alkaline pyrophosphates or free alkanolamine, has also been recommended to increase detergency, but unfortunately their use also leads to a loss of quality in the case of particularly delicate woolen fabrics and knitwear. Fatty acid mono and diethanolamides are also known additives for light-duty detergents. However, because of their high foaming power, the washing liquid frequently overfoams in machine washing, particularly when using automatic washing machines having a horizontally mounted drum. This applies in particular where foam-active anionic surfactants are present.

Another requirement which high-quality wool detergents have to satisfy is that they should not promote any bleeding of the fabric dyes. Only those wool detergents which satisfy certain minimum requirements with respect to 12 selected fabric dye finishes are considered as safe and allowed to bear the wool seal of the IWS (International Wool Secretariat, London and Duesseldorf). Accordingly, there is a need to provide a detergent which satisfies these more stringent requirements, and overcomes the aforenoted disadvantages.

DESCRIPTION OF THE INVENTION

It has now been found that the present invention overcomes the aforenoted disadvantages by providing liquid detergent compositions which are free of inorganic builder salts and optical brighteners wherein the detergent compositions have a pH value of from between about 6 to about 8, and the detergent compositions comprise:

(a) from about 5 to about 15% by weight of the alkylglycolether sulfate sodium salt of primary $C_{12}$–$C_{18}$ alcohols containing on average from 1 to 3 ethylene glycol ether groups;

(b) from about 15 to about 22% by weight of sodium alkylbenzene sulfonate having a linear $C_{10}$–$C_{14}$ alkyl chain;

(c) from about 0.5 to about 5% by weight of fatty acid monoethanolamide of $C_{12}$–$C_{18}$ fatty acids, of which the content of saturated $C_{12}$–$C_{14}$ fatty acids amounts to at least about 50 mole percent;

(d) from about 0.05 to about 0.5% by weight of an emulsified silicone defoaming agent;

(e) from about 0 to about 5% by weight of non-surface-active detergent additives; and (f) the remainder being water; wherein the total quantity of components (a)+(b) amounts to between about 20 and about 30% by weight, and the ratio by weight of components (a)+(b) to component (c) is between about 3:1 and about 25:1. The liquid detergent compositions are particularly useful as a detergent for fabrics of wool and silk.

Component (a) may be derived from fatty alcohols or fatty alcohol mixtures of natural or synthetic origin which may be linear or optionally methyl-branched in the 2-position (oxo group). Suitable fatty alcohols are preferably lauryl, myristyl, cetyl, and stearyl alcohol and also mixtures thereof. Best results are obtained with $C_{12}$–$C_{14}$ carbon chain lengths. The number of ethylene glycol ether groups on a statistical average is from about 1 to about 3, preferably about 2. Small amounts of nonethoxylated alcohols or ethoxylates containing more than 3 glycolether groups may also be present, as is normally the case where alkoxylation is carried out on an industrial scale. The sulfuric acid semiesters prepared from these alkyl(poly)glycolethers by sulfatization are present in the form of the sodium salt. The detergent compositions preferably contain from about 7 to about 13% by weight, and more preferably, from about 8 to about 12% by weight of this surfactant component (a), based on the weight of the detergent compositions.

Sodium alkylbenzene sulfonate having linear $C_{10}$–$C_{14}$ alkyl chains is used as component (b), and is preferably sodium dodecylbenzene sulfonate. The amount of component (b) is from about 15 to about 22% by weight and preferably from about 16 to about 20% by weight, based on the weight of the detergent compositions. The total amount of components (a)+(b) should be between about 20 and about 30% by weight, based on the weight of the detergent composition.

Component (c) may be derived from fatty acids of natural or synthetic origin and preferably from natural fatty acid mixtures, such as coconut oil fatty acids after separation of the fractions containing less than 12 carbon atoms. Suitable mixtures may contain, for example, lauric acid, myristic acid, palmitic acid, stearic acid and oleic acid, although the content of saturated $C_{12}$–$C_{14}$ fatty acids should amount to at least about 50 mole percent, and preferably to at least 60 mole percent, of the fatty acids. The fatty acid monoethanolamides obtained by reaction with monoethanolamine should not contain any free ethanolamine and should provide a substantially neutral product. Accordingly, it is advisable to neutralize any alkaline-reacting constituents still present, preferably with organic acids, such as acetic acid, lactic acid, glycolic acid or citric acid, so that the pH value of the detergent composition is preferably in the range of from about 6.5 to about 7.5. The content of component (c) in the detergent composition is preferably from about 1 to about 3% by weight, and more preferably from about 1.2 to about 2.5% by weight, based on the weight of the detergent composition.

The total quantity of components (a)+(b) should be from about 20 to about 30% by weight, and preferably from about 23 to about 28% by weight, based on the weight of the detergent composition, while the ratio by weight of components (a)+(b) to component (c) should preferably be from about 4:1 to about 10:1.

Component (d) may be an organopolysiloxane which is present in admixture with from about 1 to about 10% by weight, based on the weight of component (d), of a finely divided, preferably silanized silica, and of an emulsifier for uniformly distributing the organopolysiloxane in water or in the water-containing mixture of components (a), (b) and (c). Dimethylpolysiloxanes present in admixture with silanized silica and nonionic emulsifiers are particularly suitable for the detergent compositions of this invention. Suitable emulsifiers may be, for example, polyglycoethers substituted by relatively long-chain alcohols, alkylphenols, fatty acids and fatty acid amides. Relatively high molecular weight, substituted polyglycolethers, block polymers of polyethylene glycol and polypropylene glycol, and mixtures of the afore-mentioned emulsifiers are also suitable. In general, the mixtures of dimethylpolysiloxane, silica and emulsifier are commercially available as ready-made products.

Other optional ingredients (e) may be non-surface-active or non-alkaline-reacting detergent additives, such as dyes, perfumes, preservatives, such as formalin for example, complexing agents for traces of heavy metals such as for example, ethylene diamine tetraacetate (EDTA), low molecular weight carboxylic or polycarboxylic acids, agents to adjusting the pH-value of the detergent, and agents for regulating the viscosity of the aqueous concentrate, such as lower alcohols, glycerol or glycolethers and neutral salts, such as sodium chloride. Individually, these constitutents are present in quantities of less than about 1% by weight, and generally in quantities of less than 0.5% by weight, based on the weight of the detergent composition. The total quantity in which they are present should not exceed about 5% by weight, based on the weight of the detergent composition.

The detergent compositions of this invention are present in the form of aqueous, storable concentrates. In this form, they are particularly easy to dispense and to disperse uniformly in a washing solution. They may be used both for handwashing and also for machine washing, with machine washing being preferred, especially since the detergent compositions are specially designed for machine washing. The detergents are suitable for washing delicate fabrics, particularly knitted fabrics of wool and silk, including delicate angora wool. Besides providing very good washing results, the fabrics do not become hard, but retain their natural softness and their gentle and loose feel not ony with hand washing, but also with machine washing using automatic washing machines in the so-called woolens, or delicate fabrics cycle.

In addition, the present invention also relates to a process for the gentle washing of woolen fabrics in tumbler-type washing machines with minimal mechanical agitation of the washing at temperatures in the range of from about 20° C. to about 40° C., and with a liquor ratio (kg of washing per liter of wash liquor) of from about 1:20 to about 1:40, using from about 2 to about 6 g/l of a liquid detergent having a pH-value of from about 6.5 to about 7.5 and comprising the following composition:

(a) from about 5 to about 15% by weight of the alkylglycolether sulfate sodium salt of primary $C_{12}$–$C_{18}$ alcohols containing on average from 1 to 3 ethylene glycol ether groups;

(b) from about 15 to about 22% by weight of sodium alkylbenzene sulfonate having a linear $C_{10}$–$C_{14}$ alkyl chain;

(c) from about 0.5 to about 5% by weight of fatty acid monoethanolamide of $C_{12}$–$C_{18}$ fatty acids, of which the content of saturated $C_{12}$–$C_{14}$ fatty acids amounts to at least about 50 mole percent;

(d) from about 0.05 to about 0.5% by weight of an emulsified silicone defoaming agent;

(e) from about 0 to about 5% by weight of non-surface-active detergent additives; and (f) the remainder being water; wherein the total quantity of components (a)+(b) amounts to between about 20 and about 30% by weight, and the ratio by weight of components (a)+(b) to component (c) is between about 3:1 and about 25:1. All parts and percentages by weight are based on the weight of the liquid detergent composition.

The mechanical agitation of the washed fabrics in the washing machine should be comparatively slight for a high washing liquor level, which is generally obtained in automatic washing machines having a special woolens or delicate fabrics cycle. The washing liquor temperature is preferably from about 25° to about 35° C., while the liquor ratio is preferably from about 1:25 to about 1:50. Foaming problems, i.e., overfoaming of the washing solution or heavy after-foaming during rinsing with water, do not arise.

Although certain embodiments of the invention have been selected for description in the examples hereinafter, it will be appreciated by those skilled in the art that these examples are merely illustrative of, but do not in any way limit, the scope of the present invention which is defined in the appended claims.

EXAMPLE 1

A solution of about 10 kg of sodium alkylglycolether sulfate (2 ethylene glycolether groups, cocosalkyl groups, chain length 55% $C_{12}$, 22% $C_{14}$, 11% $C_{16}$ and 12% $C_{18}$), and about 16 kg of sodium dodecylbenzene sulfonate in about 66.1 kg of water was heated to about 85° C. After addition of about 1.5 kg of coconut oil fatty acid monoethanolamide, about 3 kg of triethylene glycol and about 1 kg of glycol distearate (pearlizing opacifier) and homogenization, followed by cooling of the solution to about 30° C., about 1.4 kg of a 20% by weight aqueous silicone defoamer solution (Polymekon WM 20, a product of the Goldschmidt Company, Essen, Federal Republic of Germany) was added, corresponding to an addition of about 280 g of pure anhydrous silicone defoamer. Instead of the aforementioned defoamer, about 2.8 kg of defoamer emulsion DB 110 A of DOW-CORNING, USA (active content 10% by weight) may also be used in the same way. After addition of about 100 g of 30% formalin solution (preservative) and about 800 g of perfume oil, the solution was adjusted to a pH value of about 7 with about 100 g of citric acid. The total water content of the finished liquid detergent was about 67.3% by weight. The solution was stable in storage and unaffected by low temperatures.

EXAMPLE 2

A stable aqueous solution of the following components (in % by weight) was prepared in the same way as described in Example 1:

10.0% Na-cocosalkyl diglycolether sulfate,
2.0% coconut oil fatty acid monoethanolamide,
18.0% Na-dodecylbenzene sulfonate,
1.5% defoamer emulsion (DB 110 A),
3.0% triethylene glycol,
0.1% EDTA-Na
0.5% glycerol monostearate,
0.1% formalin solution,
0.1% citric acid,
remainder water;
pH-value 7.

The products of Example 1 and Example 2 were tested under the following conditions on pullovers made of 50% angora wool and 50% lambswool:

| | Handwashing | Machine washing |
|---|---|---|
| Concentration (g/l) | 3.5 | 2 |
| Liquor ratio (kg/l) | 1:10 | 1:30 |
| Wash temperature (°C.) | 30 | 30 |
| Washing time (mins.) | 2 | 15 |

Machine washing was carried out in a commerically available automatic washing machine with a horizontally mounted drum using the woolens cycle. Foaming was moderate, i.e., the empty space above the liquid was only about half-filled with foam. After-foaming during rinsing was minimal in the first rinse and did not occur at all in the second and third rinses.

The following values were assigned for softness and degree of matting after five washes:
1: very soft, no matting;
2: soft, slight matting;
3: moderately soft, distinct matting.

Values of 1 to 3 were also assigned for the cleaning effect as tested on standardized test stains using the same concentration of detergent;
1: very good;
2: good;
3: satisfactory;

Testing for wool seal quality was carried out by the method published by the International Wool Secretariat (Test Method No. 240). The symbol "+" denotes wool seal quality. Four commercially available wool detergents were used for comparison.

Detergent I contained 19% of nonionic surfactant (fatty alcohol polyglycolether) and 4% of dimethyl ditallow alkylammonium chloride.

Detergent II contained 23.5% of nonionic surfactant (fatty alcohol polyglycolether) and 2.5% of quaternary ammonium salt (softener).

Detergent III contained 15% of alkylbenzene sulfonate and 7% of nonionic surfactant (polyalcohol polyglycolether).

Detergent IV contained 12.5% of alkylbenzene sulfonate, 7.5% of fatty alcohol diglycolether sulfate, 1% of fatty acid diethanolamide and 1% of an ampholytic surfactant in addition to small quantities of sodium pyrophosphate.

The results are shown in the following Table:

| Detergent | Softness | Matting | Cleaning | Wool seal test |
|---|---|---|---|---|
| Example 1 | 1–2 | 1–2 | 1–2 | + |
| Example 2 | 1–2 | 1–2 | 1–2 | + |
| Detergent I | 1–2 | 1–2 | 1–2 | – |
| Detergent II | 2 | 1–2 | 1–2 | – |
| Detergent III | 2–3 | 2–3 | 1–2 | – |
| Detergent IV | 1–2 | 1–2 | 2 | – |

It can be seen from the preceeding test results that only the products of Example 1 and Example 2 satisfactorily met all test criteria, especially the wool seal test which was failed by the commercially available wool detergents evaluated.

I claim:

1. A liquid detergent composition for fabrics of wool and silk which is free of inorganic builder salts and optical brighteners having a pH-value of from between about 6 and about 8, consisting essentially of:
(a) from about 5 to about 15% by weight of the alkylglycolether sulfate sodium salt of primary $C_{12}$–$C_{18}$ alcohols containing on average from 1 to 3 ethylene glycol ether groups;
(b) from about 15 to about 22% by weight of sodium alkylbenzene sulfonate having a linear $C_{10}$–$C_{14}$ alkyl chain;
(c) from about 0.5 to about 5% by weight of fatty acid monoethanolamide of $C_{12}$–$C_{18}$ fatty acids, wherein the content of saturated $C_{12}$–$C_{14}$ fatty acids amounts to at least about 50 mole percent;
(d) from about 0.05 to about 0.5% by weight of an emulsified silicone defoaming agent;
(e) from about 0 to about 5% by weight of non-surface-active detergent additives; and
(f) the remainder being water;
wherein the total quantity of components (a)+(b) amounts to between about 20 and about 30% by weight, and the ratio by weight of components (a)+(b) to component (c) is between about 3:1 and about 25:1.

2. The detergent composition of claim 1 wherein said primary alcohols are selected from the group consisting of lauryl, myristyl, cetyl, and stearyl alcohol, and mixtures thereof.

3. The detergent composition of claim 1 wherein component (a) is present in an amount of from about 7 to about 13% by weight, based on the weight of said detergent composition.

4. The detergent composition of claim 1 wherein component (b) comprises sodium dodecylbenzene sulfonate, and component (b) is present in an amount of from about 16 to about 20% by weight, based on the weight of said detergent composition.

5. The detergent composition of claim 1 wherein component (c) is present in an amount of from about 1 to about 3% by weight, based on the weight of said detergent composition.

6. The detergent composition of claim 1 wherein the ratio by weight of components (a)+(b) to component (c) is between about 4:1 to about 10:1.

7. The detergent composition of claim 1 wherein component (d) comprises an organopolysiloxane.

8. A process for washing fabrics of wool and silk with minimal agitation of the fabrics comprising contacting said fabrics at a temperature of from about 20° C. to about 40° C. with a liquid detergent composition which is free of inorganic builder salts and optical brighteners having a pH value of between about 6 and about 8, said detergent composition comprising:

(a) from about 5 to about 15% by weight of the alkylglycolether sulfate sodium salt of primary $C_{12}$–$C_{18}$ alcohols containing on average from 1 to 3 ethylene glycol ether groups;

(b) from about 15 to about 22% by weight of sodium alkylbenzene sulfonate having a linear $C_{10}$–$C_{14}$ alkyl chain;

(c) from about 0.5 to about 5% by weight of fatty acid monoethanolamide of $C_{12}$–$C_{18}$ fatty acids, of which the content of saturated $C_{12}$–$C_{14}$ fatty acids amounts to at least about 50 mole percent;

(d) from about 0.05 to about 0.5% by weight of an emulsified silicone defoaming agent;

(e) from about 0 to about 5% by weight of non-surface-active detergent additives; and (f) the remainder being water;

wherein the total quantity of components (a)+(b) amounts to between about 20 and about 30% by weight, and the ratio by weight of components (a)+(b) to component (c) is between about 3:1 and about 25:1.

9. The process of claim 8 wherein said primary alcohols are selected from the group consisting of lauryl, myristyl, cetyl, and stearyl alcohol, and mixtures thereof.

10. The process of claim 8 wherein component (a) is present in an amount of from about 7 to about 13% by weight, based on the weight of said detergent composition.

11. The process of claim 8 wherein component (b) comprises sodium dodecylbenzene sulfonate, and component (b) is present in an amount of from about 16 to about 20% by weight, based on the weight of said detergent composition.

12. The process of claim 8 wherein component (c) is present in an amount of from about 1 to about 3% by weight, based on the weight of said detergent composition.

13. The process of claim 8 wherein the ratio by weight of components (a)+(b) to component (c) is between about 4:1 to about 10:1.

14. The process of claim 8 wherein component (d) comprises an organopolysiloxane.

15. The process of claim 8 wherein said detergent composition is employed at a concentration of from about 2 to about 6 g/l of washing liquor during the washing of said fabrics.

16. The process of claim 8 wherein said detergent composition is employed at a washing liquor ratio, expressed as kilograms of fabrics per liter of washing liquor, of from about 1:20 to about 1:40.

17. The process of claim 8 wherein component (a) comprises sodium cocosalkyl diglycolether sulfate, and component (c) comprises coconut oil fatty acid monoethanolamide.

* * * * *